United States Patent [19]

Allen

[11] Patent Number: 4,940,236

[45] Date of Patent: Jul. 10, 1990

[54] COMPUTER GOLF CLUB

[76] Inventor: Dillis V. Allen, 240 Lincolnshire, Schaumburg, Ill. 60007

[21] Appl. No.: 759,358

[22] Filed: Jul. 26, 1985

[51] Int. Cl.[5] ..... A63B 53/04

[52] U.S. Cl. ..... 273/183 D; 273/184 R; 273/186 R; 273/194 R

[58] Field of Search ..... 273/181 G, 183 D, 184 R, 273/186 R, 186 C, 167 J, 173, 162 R, 162 A; 310/338, 318, 319, 800

[56] References Cited

U.S. PATENT DOCUMENTS 4,088,324 5/1978 Farmer ..... 273/186 A
4,499,394 2/1985 Koal ..... 310/340

FOREIGN PATENT DOCUMENTS 2066676 7/1981 United Kingdom ..... 273/186 A

*Primary Examiner*—Edward M. Coven
*Assistant Examiner*—Dean Small

[57] ABSTRACT

A golf ball distance computer built entirely into a golf club utilizing a molecularly polarized piezoelectric plastic film composite as a ball impact transducer.

13 Claims, 5 Drawing Sheets

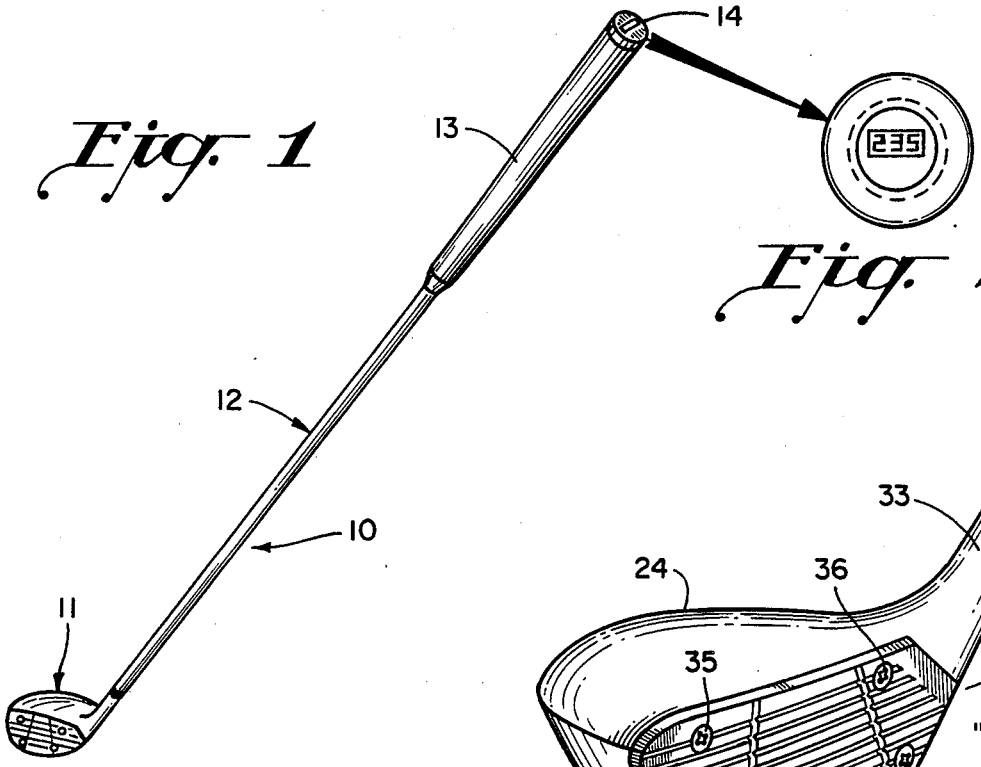
Fig. 1
Fig. 2
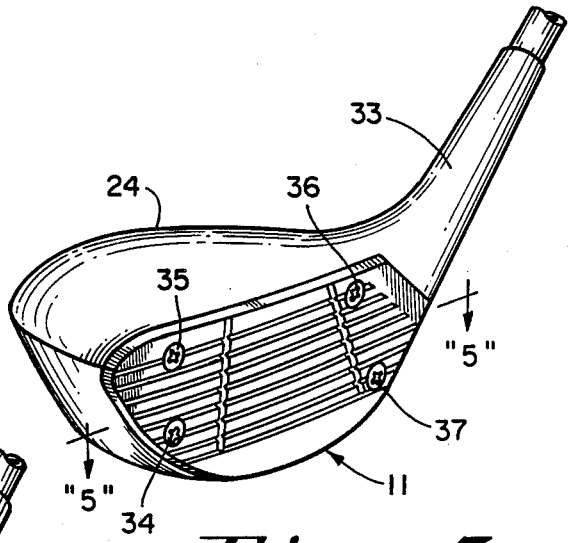
Fig. 3
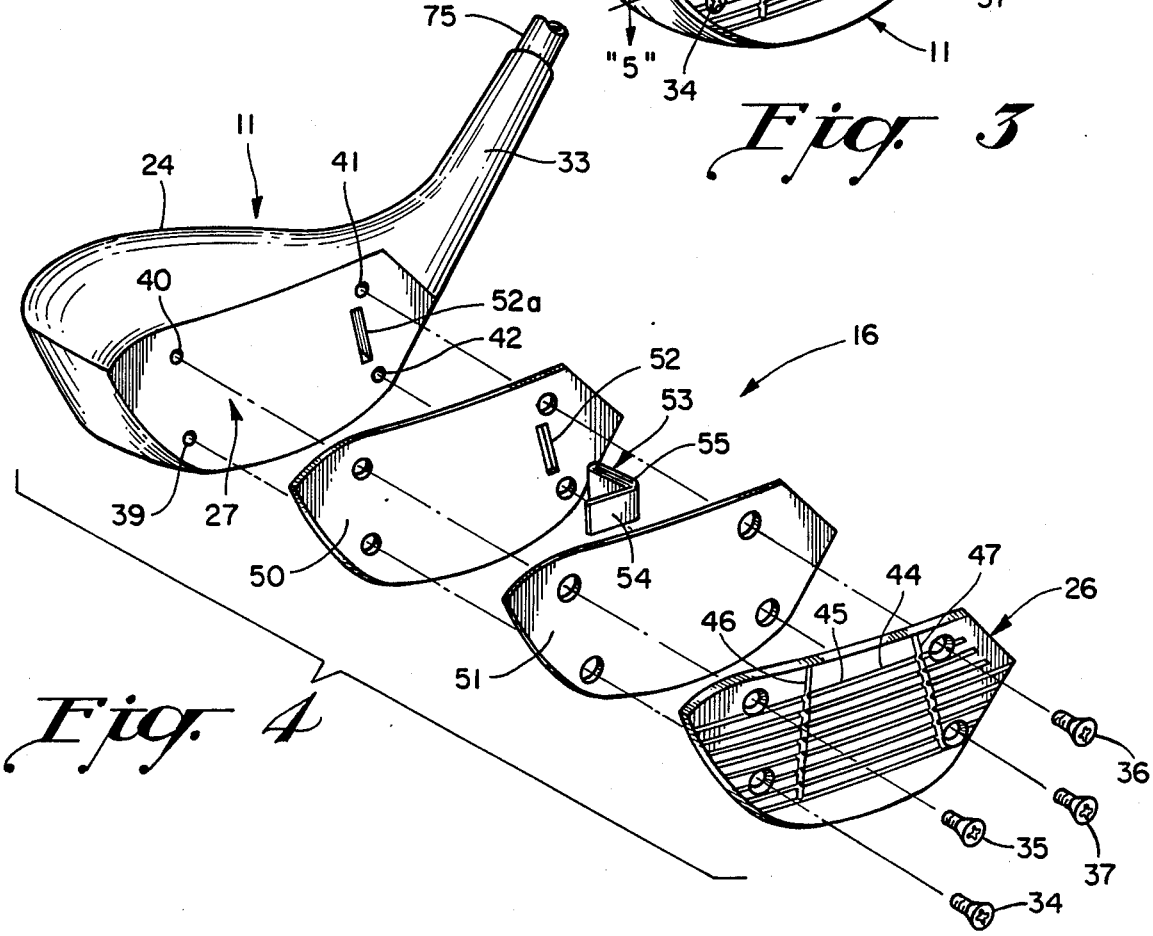
Fig. 4

16
50
51

55
52a
53
54
50
56
"11"
"11"
59
58
57
16
51

78
81
79

17
87
82
80
78
85
13
12
19
83
81
"13"
"13"
82
79
76
93
91
92
90
105
97
84
98
104
149
110
100
89
14
101
108
102
96
88
21

COMPUTER GOLF CLUB

BACKGROUND OF THE PRESENT INVENTION

There have been a plurality of attempts over the last several decades to incorporate electronic swing analyzing devices directly into golf clubs, particularly into "wood" clubs, bearing in mind that today's "wooden clubs" are constructed of metal and other materials such as compression molded graphite, besides natural wood.

Such swing analyzing devices include swing angle sensing devices that use orthogonally related accelerometers located within the club head to provide club head deceleration signals occurring during impact to analyzing circuitry located externally of the club head, and a ball distance computer driven by a single accelerometer mounted within the club head providing club head deceleration signals to an analyzing circuitry mounted within the club head grip.

While there appears to be a demand for such self-contained club swing analyzing devices, none has achieved any degree of commercial success thus far for a plurality of reasons. Firstly, there has been a general misunderstanding in the prior art with respect to the physics involved in club-ball collision, and there has also been a failure to provide accurate conditioning signal production and proper signal modification to achieve a proportional representation of the sensed condition. For example, in a known distance computer, an accelerometer is employed to sense club head deceleration during and after ball impact. While club head deceleration is one parameter that determines ball exit velocity from the club face, it cannot by itself provide an accurate determination of ball exit velocity without knowing the time of impact between the ball and the club or initial club head velocity. The correct collision theory formula for determining ball exit velocity $V_{b2}$ is $m_1V_{b1}+\int Fdt=m_2V_{b2}$, where the $V_{b1}$=initial ball velocity, $m_1$=initial mass of ball, F=impact force between the ball and the club, and t=the time of impact between the ball and the club, $m_2$=final ball mass, and $V_{b2}$=the exit velocity of ball from the club. A similar equation may be derived with respect to the club head as opposed to the ball during collision.

Since initial ball velocity is zero and mass m is constant, it can readily be seen that final ball velocity $V_{b2}$ is proportional to the integral $\int Fdt$ or more simply expressed, exit ball velocity is proportional to the average impact force between the ball and the club head multiplied by the time duration of impact. Thus one problem in prior art devices for measuring ball distance is that they do not take into account the duration of impact between the ball and the club.

This time duration of impact can be expressed in laymen's terms as the follow-through of the club impacting on the ball, and the longer the time period of impact the greater the exiting ball velocity and the greater the distance the ball travels.

Another deficiency in built-in swing analyzing devices and particularly ball distance computers is that known sensing or transducing devices cannot be readily built into the club head either because they are not sufficiently durable or because they alter the weight, swing-weight or torquing characteristics of the club. Even a small additional weight added to the club head alters swing-weight significantly, for example 1.0+ grams added to the club head increases the swing-weight of the club one full swing-weight, e.g. from D-1 to D-2, in addition to increasing the overall weight of the club head. While this weight addition can be compensated in terms of swing weight by adding weight to the butt end of the shaft, such a compensating maneuver is not desirable because it further increases the overall weight of the club. Thus, these prior built-in sensing and computing devices have not been acceptable because they either varied the club's swing weight or the overall weight of the club, or both.

Built-in swing sensing and computing devices have also not demonstrated an acceptable level of durability to withstand the high force impact, frequently over 50 lbs., generated in the few milliseconds or less of impact time.

Furthermore, in all of the prior literature on built-in swing analyzing devices there is a notable lack of technology with respect to specific transducer constructions and the exact method of attaching the transducer to the club head.

Another problem in these prior systems is that they do not take into account the non-linear relation between ball-club impact and ball travel distance.

A ball distance computing device manufactured by Mitsubishi Corp. has achieved some degree of commercial success even though the sensing device, computer circuitry and visual display are external to the club head. This system utilizes a Hall effect transducer in a floor mat driven by magnetic tape attached to the club head, and while this system has been found satisfactory for many purposes, it produces inaccuracies in the ball distance computing function because of the failure to measure ball impact time, because of misapplication of the magnetic tape to the club head and failure to account for club head mass, and because exact club head loft angle is not considered, all of which control ball travel distance.

An example of a built-in ball distance computer is shown and described in the Farmer U.S. Pat. No. 4,088,324 and it utilizes an accelerometer in the club head in an attempt to compute ball distance. Accelerometers built into the club head are also shown in the Evans U.S. Pat. Nos. 3,788,647; 3,806,131 and 3,270,564 as well as the Hammond U.S. Pat. No. 3,945,646, for generating information relating to ball striking direction as well as club velocity and acceleration.

It is a primary object of the present invention to ameliorate the problems noted above in club built-in swing analyzing devices and particularly to club self-contained distance computers.

SUMMARY OF THE PRESENT INVENTION

In accordance with the present invention a golf ball distance computer is provided incorporated entirely within a conventionally styled club without significantly altering the swing-weight, total weight, feel or durability of the club.

Toward this end the present computer club is provided with a transducer built into the forward face of a metal club head that produces signals representing the impact force and duration of impact between the ball and the club, and signal processing circuitry built inside a conventional "Tru-Temper"* shaft that drives an LCD display built into a grip cap at the butt end of the shaft. The transducer is a polarized piezoelectric polyvinyladin fluoride bimorph that has a shape corresponding to the front face of the club head. It provides accurate impact readings almost entirely across the club face.

*Reg. TM of Tru-Temper Corp.

The club head itself is preferably investment cast stainless steel having a wall thickness of approximately 0.125 inches throughout except for the forward wall, ordinarily the ball striking wall of the club, which is 0.080 inches. This latter wall thickness has been found necessary to provide club face structural integrity and to achieve reduced club head subassembly weight. For a men's driver, an exemplary overall club head weight is 205 grams and this weight can be achieved with a conventional 0.125 inch walled stainless steel club filled with a suitable foam material.

The forward wall a reduced thickness compensates for the additional weight of the remaining transducer components. This forward wall has a uniform thickness and has roll and bulge identical to the desired roll and bulge for the club face, i.e. vertical plane radius and horizontal plane radius. The transducer bimorph is mounted on the forward surface of this forward wall and in one embodiment has an L-shaped copper conductor sandwiched between the films that extends through a diagonal slot in the wall into the hollow interior of the club head adjacent the club head hosel.

The transducer and forward wall of the club head are covered by a face plate that defines the ball striking surface. This face plate is constructed of a die cast high-impact magnesium alloy and is fastened to the club head forward wall by four threaded screws that impale the transducer. The face plate has score lines or grooves molded in so that no machining is required of this piece and is approximately on the order of 0.080 inches thick so that the total effective forward wall is 0.160 inches, significantly thicker but lesser in weight than the conventionally employed 0.125 inch stainless steel forward wall. The face plate has a uniform thickness with the same roll and bulge as the forward wall of the club head. The face plate with the forward stainless steel wall provide an effective forward wall strength greater than presently known stainless steel club head constructions while at the same time provide a somewhat lesser overall club head weight that compensates for the 5–10 gram weight of the transducer, connectors, cable, and associated supporting posts.

The transducer itself is extremely thin, on the order of 102 um. so that its contribution to the increase in effective thickness of the forward wall and is insignificant. An important advantage of the present transducer is its capability of conforming to the roll and bulge radii on the forward wall, which it can do because of the flexibility of the polymer film from which the transducer is constructed. During manufacture the transducer is applied to the forward wall of the club head and then coated with an epoxy film along with the surrounding portions of the forward wall and plate. The face plate is then placed over the forward wall and threaded down tightly with the fasteners. This pots the transducer between the face plate and the forward wall without any voids and reduces face plate vibration that would otherwise provide unwanted transducer signals, and at the same time improves impact "feel" of the entire club.

In assembling the transducer subassembly, the positive or+sides of the two polyvinyladin fluoride films are placed toward one another so that the negative sides of the films face outwardly and engage the club head forward wall and the face plate. In this way the club head face plate, and shaft themselves form an effective ground and excellent electrical shield for the transducer and its circuit without any additional components. In one embodiment of the present invention both the club head and the club shaft are electrically conductive and connected together so that they shield both the transducer and a conductor connecting the transducer to the shaft mounted circuitry eliminating the need for a coax type cable with its cost and extra weight.

The circuit components are mounted on an elongated circuit board carried within the butt end of a conventional 0.620 inch butt diameter club shaft. The PC board is mounted in the shaft parallel to the shaft axis with several "O" rings in a very inexpensive fashion while at the same time providing a shock mount for the board.

The transducer provides a somewhat sinusoidally shaped pulse at impact representing the force of impact with a time base equalling the time duration of impact. The circuitry integrates this signal, thereby deriving a signal proportional to the impulse delivered to the ball, i.e. the parameter $\int F dt$ defined above, proportional to the ball exit velocity $V_{b2}$. The circuitry utilizes this signal to drive an LCD driving circuit that in turn drives the LCD indicator mounted in the end cap. While the circuitry and LCD add several grams to the overall weight of the club, this additional weight can be utilized to offset any small increase in weight in the club head, if that be necessary, without affecting swing-weight and these several grams have negligible effect on the overall club weight feel since the overall club weighs on the order of 340 grams.

BRIEF DESCRIPTION OF THE DRAWINGS

FIG. 1 is a perspective view of a golf driver incorporating the principles of the present invention;

FIG. 2 is an enlarged top view of an end cap subassembly;

FIG. 3 is an enlarged perspective view of the club head illustrated in FIG. 1;

FIG. 4 is an exploded perspective of the club head assembly illustrated in FIG. 3;

DETAILED DESCRIPTION OF THE PREFERRED EMBODIMENTS

Figure 5:
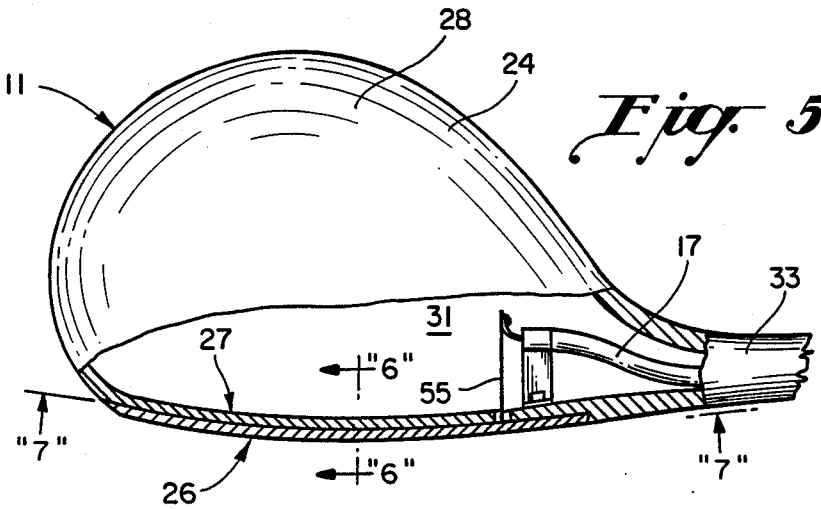
FIG. 5 is an enlarged fragmentary section taken generally along line 5—5 of FIG. 3 illustrating the forward wall assembly of the head.
Figure 6:
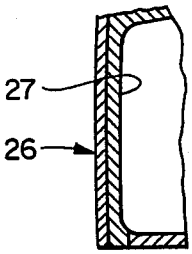
FIG. 6 is a fragmentary section taken generally along line 6—6 of FIG. 5 illustrating the forward wall assembly of the head.
Figure 7:
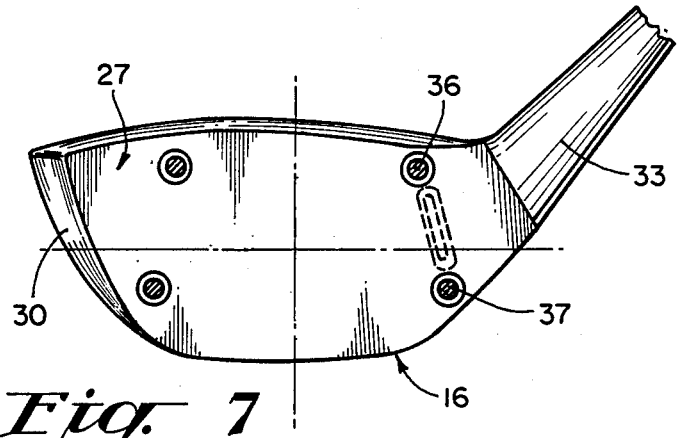
FIG. 7 is a front view of the club head assembly with the face plate removed illustrating the transducer.

Referring to the drawings and particularly to FIGS. 1 to 8, a computer driver golf club 10 is illustrated consisting generally of a club head assembly 11, a shaft 12, a grip 13 and a grip end cap assembly 14. The club head assembly 11 includes a tranducer assembly 16 that derives signals responsive to impacting the club head 11 against a golf ball, that are conducted through a coaxial cable 17 (FIG. 5 and 8) extending through the club head 11 and the hollow shaft 12 to a circuit assembly 19 mounted within hollow shaft 12 adjacent its butt end (see FIG. 12) that drives a visual display LCD assembly 21 contained within the end cap assembly 14 in a manner to display directly total yardage traveled by the impacted ball.

The club head assembly 11 also includes an investment cast stainless steel club head 24 and a magnesium alloy face plate 26. Club head subassembly 24 is by itself similar in design to many stainless steel "wooden" club heads manufactured today. That is, it is an investment casting constructed of a fairly low chromium content stainless steel with a substantially uniform wall thickness of approximately 0.125 inches, except that its forward wall 27 has a somewhat lesser thickness than the remaining portions of the club head and preferably has a thickness on the order of 0.080 inches. Club head subassembly 24 is heat-treated to a hardness on the Rockwell-D scale of approximately 30 and is seen to generally include a spheroidal top wall 28, spheroidal forward wall 27, spheroidal side wall 30, sole plate 31 and hosel 33. The geometry of the top wall 28, side wall 30, sole plate 31 and hostle 33 is conventional.

The forward wall 27 is smooth without any score lines and is of uniform thickness having a roll and bulge identical to that desired on the face plate 26. For example, the forward wall 27 may have a bulge radius, i.e. radius in a horizontal plane, of 10 inches, and a roll radius, i.e. radius in a vertical plane passing through the center line of the club head, of 10 inches.

The reduced thickness of the forward wall 27 compensates and offsets the added club head weight of the transducer 16 (almost negligible) and the lightweight magnesium face plate 26. There is however no loss in forward wall strength because of the supporting and strengthening function provided by the face plate 26. The magnesium face plate 26 also has excellent vibration dampening characteristics which not only improve club "feel" but also improve the shape of the transducer signal.

The magnesium face plate 26 has an outer configuration complementary to the forward face 27 of club head subassembly 24 and is fastened to the club head forward face 27 by four threaded fasteners 34, 35, 36 and 37 that threadedly engage threaded bores 39, 40, 41 and 42 in the club head forward face 27. Face plate 26 is preferably constructed of a high impact magnesium alloy such as AZ91B which contains 99% Al., 0.13 Mn. and 0.7 Zn. as alloys. Since face plate 26 has a uniform thickness of 0.080 inches, the effective composite forward wall thickness is approximately 0.160 inches, some 0.035 inches thicker than the conventional 0.125 inch walls found in today's stainless steel club heads. This additional thickness compensates for the somewhat lesser strength of the magnesium alloy plate. Because magnesium is five times lighter than stainless steel the combined forward wall assembly has a somewhat lesser weight than a standard club head with a 0.125 inch forward wall. The added weight of the transducer, connectors, cable and circuit board results in overall club weight equal to a conventional club with about the same swing weight because the circuit board weight at the butt end balances the transducer, connectors and effective cable at the head end in the 2 to 1 swing weight ratio.

The face plate 26 has a roll and bulge on both sides thereof equal to the roll and bulge on the forward club head wall 27, and it has horizontal grooves 45 and two converging generally vertical grooves 46 and 47 therein.

The transducer assembly 16 is complementary in shape to the face 27 but 0.030 inches smaller and is a bimorph of two polyvinyladin fluoride films 50 and 51 that sandwich an "L" shaped copper plate conductor 53 having leg portions 54 and 55. Each of the films 50 and 51 is molecularly polarized with a high-energy electrical field by known polarization techniques to provide the desired piezoelectric effect. One such piezoelectric film that has been found satisfactory is manufactured under the trademark "Kynar" by Pennwalt Corp.

Figures 10, 11, 12, 13:
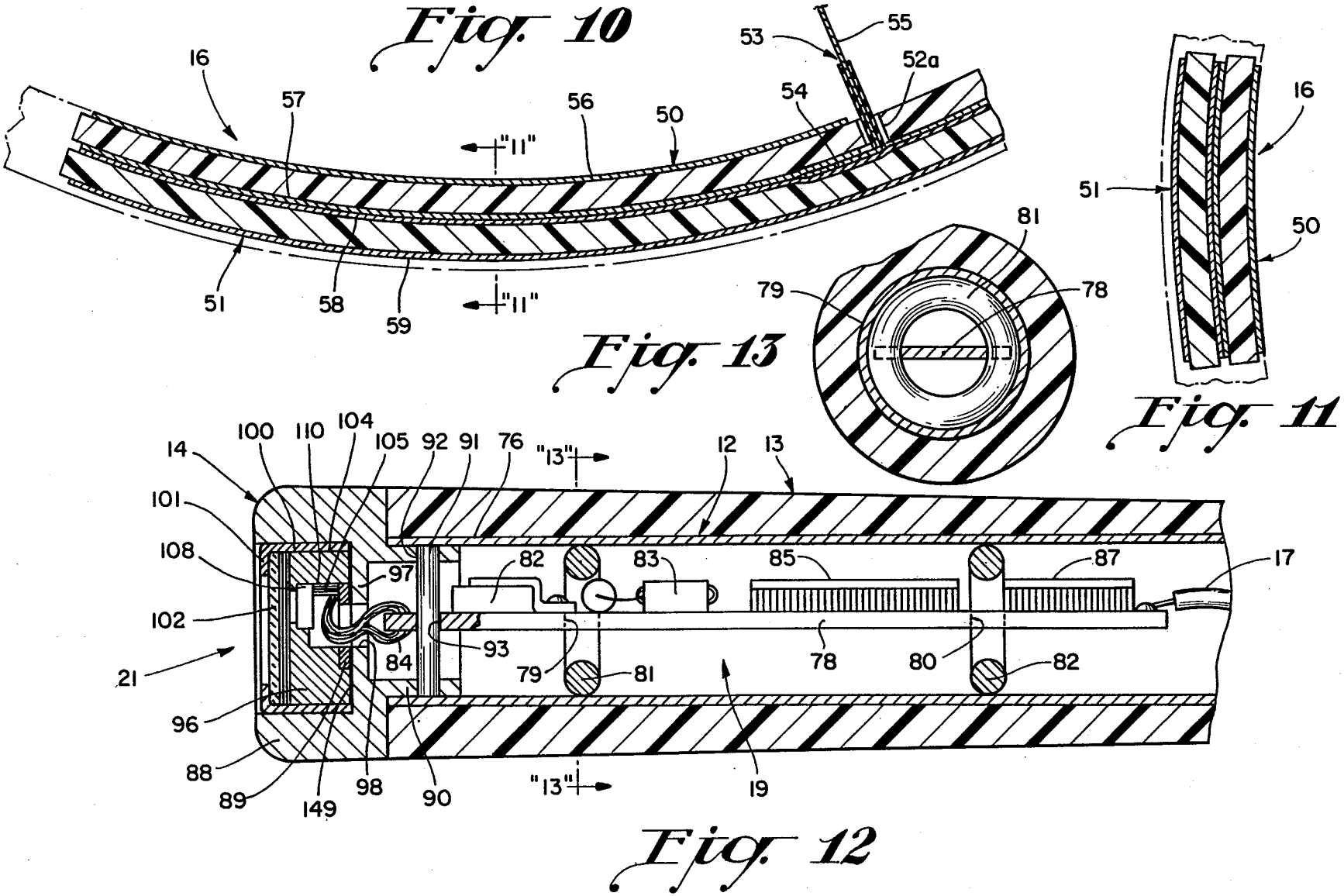
FIG. 10 is an enlarged longitudinal section of the transducer illustrated in FIG. 7.
FIG. 11 is a cross-section of the transducer assembly taken generally along line 11—11 of FIG. 10.
FIG. 12 is a fragmentary longitudinal section of the butt end of the golf shaft illustrated in FIG. 1 showing the LCD display and circuit board assemblies.
FIG. 13 is a cross-section of the butt end of the club taken generally along line 13—13 of FIG. 12 showing a portion of the circuit board.

The films 50 and 51 each have a thickness of approximately 52 um. and are sufficiently flexible to conform to both the roll and bulge of the forward wall 27 and face plate 26 as seen clearly in FIGS. 10 and 11. Both surfaces of the polarized films 50 and 51 have conductive aluminum alloy coatings (electrodes) 56, 57, 58 and 59 with electrodes 57 and 58 being positive and electrodes 56 and 59 being negative. The films are bonded together with a uniformly applied contact adhesive. This arrangement grounds the transducer to both the club head 24 and face plate 26. In this way the club head 24 and the face plate 26 serve to electrically shield the transducer 16 from undesirable transients.

The "L" shaped plate conductor 53 is in electrical contact with both positive electrodes 57 and 58. The conductor or terminal 53 has a width of approximately 0.25 inches and a thickness of approximately 0.010 inches except that leg 54 as seen in FIGS. 4 and 10 may be thinned down to 0.006 inches to minimize the space between the forward wall 27 and the rear of face plate 26. The terminal leg 55 extends through a diagonal slot 52 in film 50 and complementary aligned slot 52*a* in club head forward wall 27 into the hollow interior of the club head. Slot 52*a* is positioned near the hosel end of the club head 33 approximately on a line between fasteners 36 and 37.

In assembly, the transducer assembly 16 is temporarily attached to forward wall 27 and face plate 26 with a uniformly applied high-strength contact adhesive. This assures that there will be no relative movement between the face plate 26, the forward wall 27 and the transducer assembly 16, and in this manner unwanted vibration of the elements are eliminated or minized so that they are not seen by the transducer 16 thereby providing improved signal generation.

Figure 8:
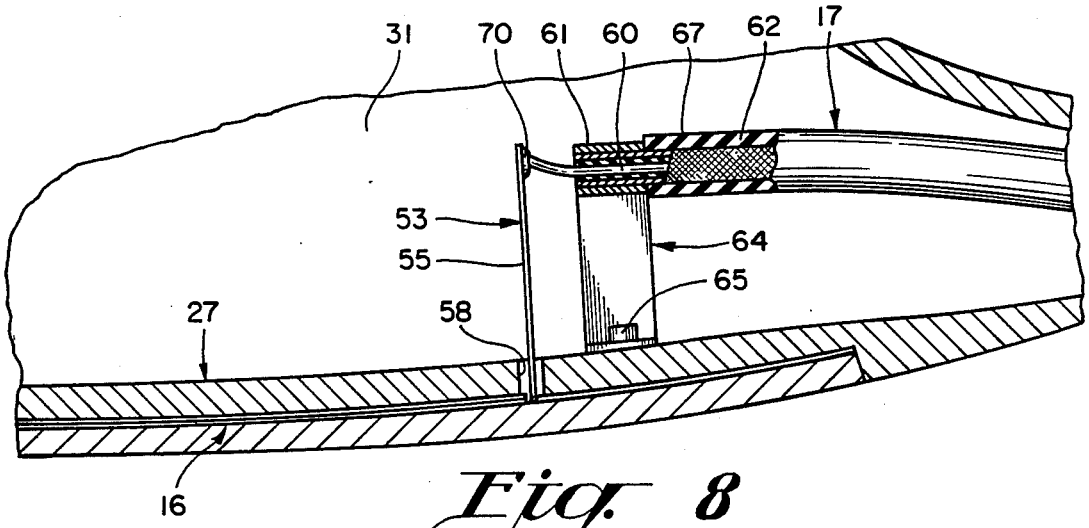
FIG. 8 is an enlarged fragmentary section of the forward wall similar to that shown in FIG. 5.

As seen in FIG. 8, cable 17 is a small gauge coax-type cable such as 174 U and is seen to include central conductor 60 surrounded by insulation, an annular conductive mesh sheath 61 and an outer layer of insulation 62. A conductive support post 64 is fastened to the rear of forward wall 27 by a threaded fastener 65 and has an upper portion 67 that surrounds and clamps against the ground sheath 61. In this way the cable 17 is grounded to the club head 24 and face plate 26 though screws 34, 35, 36 and 37 and transducer 16. The central conductor 60 is connected to terminal 53 by soldering at 70 and is conveniently held in position during soldering by the support post 64.

Figure 9:
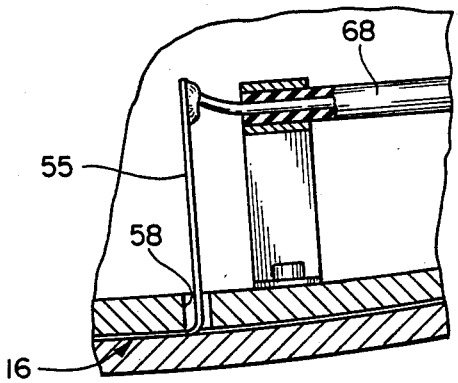
FIG. 9 is a fragmentary section similar to FIG. 8 illustrating a modified form of a conductor assembly.

Alternatively and as seen in FIG. 9 an unshielded conductor 68 may be provided utilizing the club head 24 and the club shaft 12 to shield the conductor 68. In this case the shaft 12 is conductive and connected to club head 12 by a conductive epoxy. Circuit 19 is then grounded to shaft 12 as well. This eliminates the need for the somewhat more costly and heavier coaxial cable 17 in the FIG. 8 embodiment.

As an alternative to the "L" shaped terminal 53, and the bimorph lamination of transducer 16, a single film transducer can also be employed with an integral coplanar tab that extends through the slot 52*a* into the club head interior. The tab has laterally spaced positive and negative terminals, that are continuation of the electrode coatings on the film, to minimize unwanted signal generation. The positive terminal is connected directly to conductor 60 with a conductive epoxy and the negative terminal connected to the coax sheath 67 by a small conductor also with conductive epoxy. A non-conductive film covers the positive side of the film isolating it from the face plate 26. This eliminates the terminal 53 from between the face plate 26 and design wall 27, providing a more uniform thickness transducer and improved signal uniformity across the club face.

It is also possible to construct the face plate of stainless steel and in this case its thickness is 0.060 to 0.080 inches depending upon the thickness of forward wall 27. The thickness of both should be equal with a total thickness in the range of 0.140 to 0.170.

Figure 16:
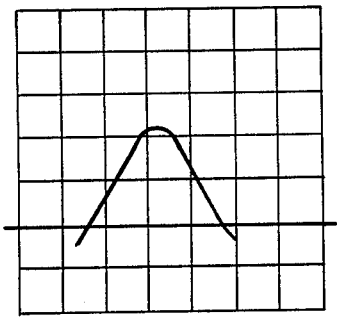
FIG. 16 is an exemplary oscilloscope tracing of a signal produced by the transducer upon a relatively low impact force applied to the club head.
Figure 17:
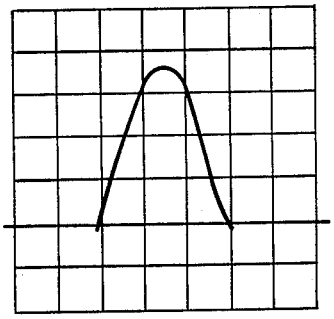
FIG. 17 is an oscilloscope tracing of a signal produced by the present transducer at a higher impact force than the signal according to FIG. 15.

The transducer 16 with the construction of face plate 26 "sees" only forces normal to the surface of the transducer 16. This is important because the polarized films 50 and 51 have piezoelectric effects in three directions and since it is not possible to electrically isolate these three effects, it is important that the transducer see only the forces desired to be measured and in this case the force desired to be measured is the normal force to the transducer compressing the films 50 and 51. In this way the transducer 16 provides a signal upon ball impact with the face plate 26 proportional to the normal compression of the films 50 and 51 with a time duration equal to the time of contact of the ball with the face plate 26. These signals are illustrated in FIGS. 16 and 17 for low-force and high-force impacts respectively and as shown are actual signals, without any signal processing and prior to receipt by the computing circuitry 19 illustrated in FIGS. 12, 14 and 15.

The club shaft 12 is a standard stepped tapered tempered steel club shaft having a constant diameter portion 75 in club head hosel 33 and an enlarged constant diameter portion 76 within grip 13 having an outer diameter of 0.620 inches and an inner diameter of approximately 0.580 inches. Tru-Temper Corp. manufactures a club shaft of this configuration that performs adequately.

The circuit assembly 19 receives the transducer compression signal from cable 17 as seen in FIG. 12 and includes an elongated narrow circuit board 78 having a first pair of opposed slots 79 in the sides thereof axially spaced from a second pair of opposed slots 80. Slots 79 and 80 receive torroidal rubber rings 81 and 82 that support and shock mount the circuit board 78 within the butt end portion 76 of the shaft 12. Circuit board 78 carries a low-voltage cylindrical battery 82, power supply components 83 and IC components 85 and 87 that provide integrator, memory and LCD driver circuitry functions described in more detail with respect to FIGS. 14 and 15. The LCD driver is connected through conductors 84 to a PC board 89 in the LCD display assembly 21.

As seen in FIG. 12, end cap 14 is generally annular in configuration and includes an enlarged flange portion 88 having an outer diameter equal to the outer diameter of the grip 13 at the butt end thereof, and a reduced annular portion 90 having an outer diameter equal to the inner diameter of the shaft portion 76. Annular portion 90 receives one end of the circuit board 19 and a roll pin 91 pressed through diametrally opposed bores 92 and a hole 93 in circuit board 78 to attach the circuit 19 to the end cap 14 so that upon removal of the end cap 14 the entire circuit 19 is removed.

The outer end of the cap 14 has a circular recess 96 therein having a bottom wall 97 with an aperture 98 therein communicating with the interior of annular cap portion 90. A membrane switch 149 is mounted in the bottom of the recess for turning the circuit 19 on and off when the display 21 is pressed by the user's thumb.

The LCD assembly 21 is entirely contained within circular recess 96 and is seen to include an annular bezel 100 having a rim 101 that holds together a transparent lens 102, a plastic generally circular plastic frame 104 with a recess 105 that receives an LCD element 108, a rubber conductor 110 and a printed conductor board 85 to which conductors 84 are attached. LCD driving signals are conducted from conductor board 85 to the LCD display 108 through the rubber conductor 110 in a fashion similar to the displays in miniaturized LCD watches commonly found in today's marketplace.

Figure 14:
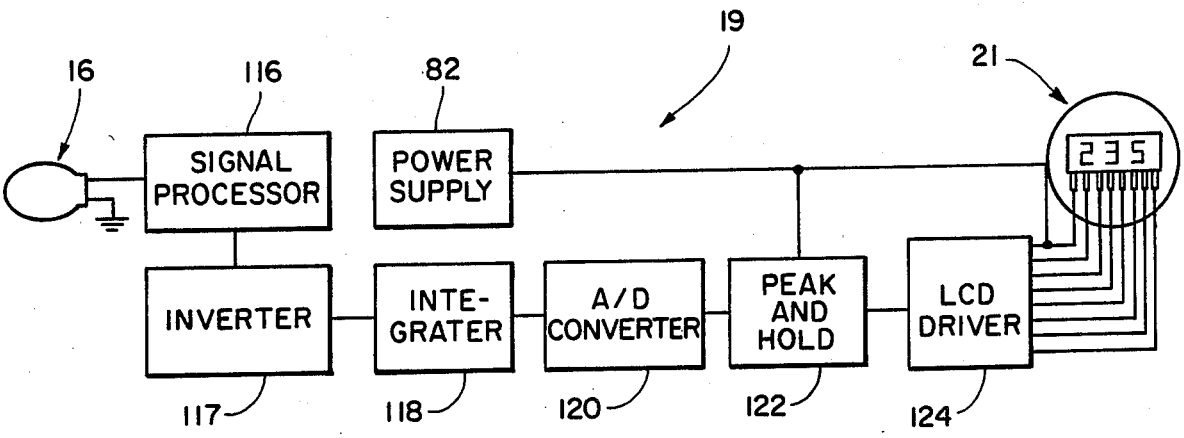
FIG. 14 is a block diagram of the computing circuit and LCD drive and display according to the present invention.

As seen in FIG. 14, the circuit 19 includes an optional signal processor 116 for shaping compression signal to remove unwanted frequencies and improve its form, and inverter and attenuator 117 and an integrator 118. Integrator 118 provides a signal proportional to the integral $\int F dt$ representing the impulse applied to the ball by the club head described above and this signal is applied to digital voltmeter-converter 120 which corrects and converts the DC level output of integrator 118 to a value proportional to total distance traveled in yards. The DC level signal at the input of A/D converter 120 is held by holding stage 122 for eight seconds while displayed on LCD display 21. A/D converter 120 provides DC level signals to LCD driver 124 that provides the necessary logic to drive the three seven bar code digits in LCD element 108.

Figure 15:
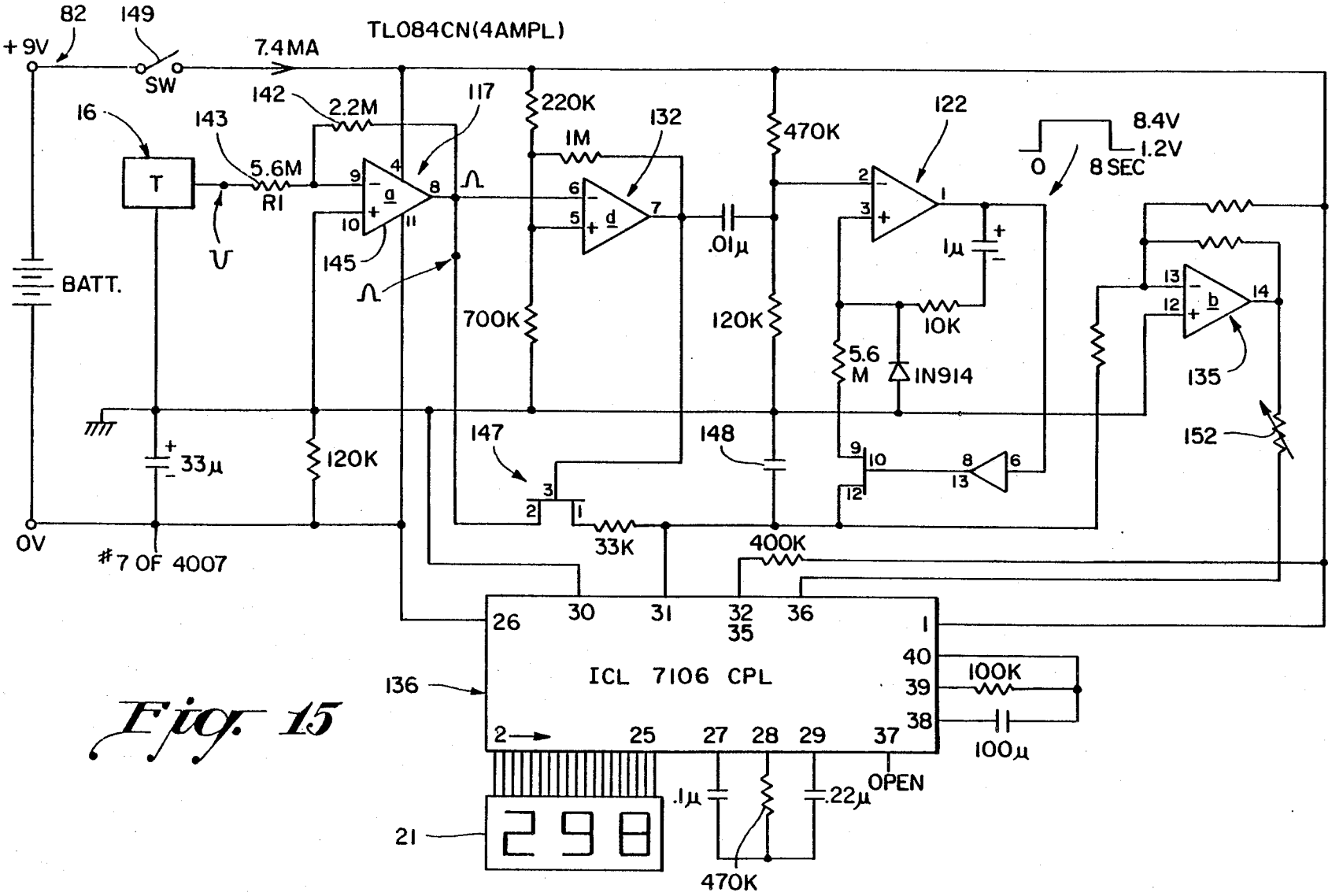
FIG. 15 is a schematic of the computing circuit, converter and display drive according to the present invention.

FIG. 15 is a schematic diagram of the present computing circuit including signal gating, an integrator, a digital voltmeter and LCD display drive, according to the present invention corresponding substantially to the block diagram illustrated in FIG. 14. As seen, the schematic generally includes a 9-volt power supply 82, power switch 149, transducer 16, an inverting stage 117, a "window" stage 132, a peak and hold stage 122, a curve matching stage 135, and an analog-to-digital converter and LCD display drive 136 that drives LCD display 21. A/D converter decoder 136 corresponds to blocks 120 and 124 in FIG. 14. The amplifiers in stages 117, 132, 122 and 135 can be on a single integrated circuit chip such as a TL 084 CN.

Resistors 142 and 143 attenuate the negative input from transducer 16 and the associated amplifier inverts the input providing an output at 8 having rise and fall times and a duty cycle equal to the transduced signal, which is on the order of 0.6 to 1.8 milliseconds (ms). The output of stage 117 is utilized in the timing or gating stage 132 to develop a gating pulse at 7 having a pulse width equal to the transduced signal, and this signal is applied to the base of gating transistor 147, which gates the output of stage 117 to input pin 31 of the analog-to-digital converter and display drive 136.

The analog-to-digital converter 136 is by itself conventional and may take the form of a single chip A/D converter, such as ICL 7106 manufactured by Intersil, Inc. It is a low-power three or three and one-half digit A/D converter that contains all necessary active devices on a single CMOS integrated circuit and it includes seven segment decoders, display drivers, reference and a clock and it is designed to interface with the liquid crystal display. Capacitor 148 integrates the gated transducer signal at input 31. The holding stage 122 provides an eight-second holding pulse for integrating capacitor 148, so that the numerical distance dislayed by display 21 appears for eight seconds and then is reset as capacitor 148 is discharged by stage 122.

The curve matching stage 135 provides an input at reference pin 36 equal to $-ke_i$ wherein k is a constant and $e_i$ is the input signal at pin 31. This provides the necessary non-linear output at pins 2 through 25 to the input at pin 31 to compensate for the non-linear relation between ball velocity $V_b$ and ball distance $S_x$. Initial ball velocity $V_b$ exiting from the clubhead at an effective angle $\theta$ is related to total distance traveled $S_x$ by the equations:

$S_x = V_x t k_1 = k_2 S_{x1}$, where $V_x$ the horizontal ball exit velocity $= \cos\theta\, V_b$, t equals elapsed time of ball travel, $k_1$ and $k_2$ are constants, $S_{x1} = V_x k_1$ and the radical $k_2 S_{x1}$ compensates for ball roll after impact with the ground. Thus total ball distance traveled is a function of $V_b^2$ and thus the $V_b$ input at pin 31 is multipled by the variable reference at pin 36 to achieve the desired $S_x$.

Potentiometer 152 varies the constant $k_2$ at pin 36 to effect small changes in the ball velocity vs. distance curve.

Pins 2 through 25 drive the three-digit LCD display 21.

I claim:

1. A golf club assembly with a self-contained ball distance computing and indicating device, comprising: a head having a forward wall generally perpendicular to an estimated line of ball flight after impact by the club head, a shaft connected to the head, a molecularly polarized flexible plastic piezoelectric film connected to the front of the forward wall that is compressed upon impact of the ball with the head and provides a signal proportional to the compression, an impact plate on the film attached to the forward wall and positioned to transmit substantially all of the impact force of a ball impacting the plate to the film as only a Z direction force, circuit means for sensing said compression signal and deriving a signal proportional to ball velocity leaving the head after impact, said circuit means deriving from said ball velocity signal a signal proportional to ball travel, and indicating means driven by the ball travel signal for providing a visual indication of ball travel.

2. A golf club assembly with a self-contained ball distance computing and indicating device as defined in claim 1, wherein the circuit means includes a holding circuit for storing the signal representing ball travel yards.

3. A golf club assembly with a self-contained ball distance computing and indicating device as defined in claim 2, including means for erasing the signal in the memory circuit after a predetermined time interval whereby the indicating means is automatically reset.

4. A golf club assembly with a self-contained ball distance computing and indicating device as defined in claim 1, wherein the circuit means for deriving a signal proportional to ball speed includes means for integrating the compression signal from the piezoelectric film whereby the ball speed signal is proportional in part to the time duration of impact of the ball and the head.

5. A golf club assembly with a self-contained distance computing and indicating device as defined in claim 1, wherein the circuit means is mounted within the shaft adjacent a distal end thereof, said shaft being constructed of an electrically conductive material, said head being constructed of an electrically conductive material, means grounding the piezoelectric film to the head, means grounding the circuit means to the shaft, and a conductor extending through the head and the shaft insulated from the head and shaft for conducting the compression signal from the piezoelectric film to the circuit means, whereby the conductor is electrically shielded by the head and the shaft.

6. A golf club assembly with a self-contained ball distance computing and indicating device, comprising: a head having a forward wall generally perpendicular to an estimated line of ball flight after impact by the club head, said forward wall being curved in at least one orthogonal direction, a molecularly polarized flexible piezoelectric film mounted on a forward surface of the wall and conforming to the contour of the wall to provide a signal proportional to film compression, a face plate attached to the forward surface of the head wall carrying the piezoelectric film and conforming in contour to the head wall, said face plate having a ball striking surface, said face plate being positioned to transmit substantially all of the impact force of a ball on the plate to the film as only a Z direction force, a shaft connected to the head, and circuit means for receiving the compression signal and deriving therefrom a signal proportional to the velocity of the ball after impact with the head.

7. A golf club assembly with a self-contained ball distance computing and indicating device as defined in claim 6, wherein the face plate striking surface has a contour conforming to the contour of the head forward wall, the forward wall and the face plate each have uniform thickness.

8. A golf club assembly with a self-contained ball distance computing and indicating device as defined in claim 6, wherein the forward wall on the face plate is curved in both orthogonal directions producing vertical roll and horizontal bulge, said piezoelectric film conforming in contour to the forward wall and face plate.

9. A golf club assembly with a self-containing ball distance computing and indicating device, comprising: a head having a forward wall generally perpendicular to an estimated line of ball flight after impact by the club head, said forward wall being curved in at least one orthogonal direction, a molecularly polarized flexible piezoelectric film mounted in a forward surface of the wall and conforming to the contour of the wall to provide a signal proportional to film compression, a face plate attached to the forward surface of the head wall carrying the piezoelectric film and conforming in contour to the head forward wall, said face plate having a ball striking surface said face plate being positioned to transmit substantially all of the impact force of a ball on the plate to the film, a shaft connected to the head, and circuit means for receiving the compression signal and deriving therefrom a signal proportional to the velocity of the ball after impact with the head, the forward wall on the face plate being curved in both orthogonal directions producing vertical roll and horizontal bulge, said piezoelectric film conforming in contour to the forward wall and face plate, circuit means in the shaft for receiving said compression signal and deriving a signal proportional to the velocity of the ball leaving the head after impact, said circuit means deriving from said ball velocity signal a signal proportional to ball travel, and indicating means in the shaft driven by the ball travel yards signal for providing a visual indication of ball travel.

10. A golf club assembly with a self-contained distance computing and indicating device, comprising: a head having a forward wall generally perpendicular to an intended line of ball flight after impact by the head, a transducer connected to the forward wall for providing a signal proportional to transducer compression produced by impact of a ball with the head, said transducer being constructed of two molecularly polarized flexible plastic piezoelectric films each having positive and negative sides with the positive sides facing one another, a shaft connected to the head, circuit means for receiving the compression signal and deriving therefrom a signal proportional to the ball distance travel after impact with the head, an elongated slot extending through the forward wall of the head adjacent the films, an "L" shaped plate conductor having one leg thereof sandwiched between the film in electrical contact with the positive sides thereof and another leg extending perpendicularly through the slot in the head, a flexible conductor connected to the other leg of the conductor plate for conducting the signal to the circuit means, and a post in the head for holding and supporting the conductor in the head.

11. A golf club assembly with a self-contained ball distance computing and indicating device as defined in claim 10, wherein the flexible conductor is a coax cable having an annular ground sheath, said post being electrically conductive and engaging the cable ground sheath to ground the cable on the head, said head being electrically conductive, said films having their negative sides in electrical contact with the head whereby the head provides a shield for the transducer and conductor.

12. A golf head assembly with a self-contained ball distance computing and indicating device, comprising: a head having a forward wall generally perpendicular to the estimated line of ball flight after impact by the head, said head being constructed of stainless steel and the forward wall a thickness substantially less than 0.125 inches, a molecularly polarized flexible plastic piezoelectric film connected to the forward wall for detecting compression upon impact of the ball with the head, and providing a signal proportional to the compression, a face plate attached to the head forward wall carrying the piezoelectric film and having a forward wall striking surface whereby ball impact force is transmitted through the face plate to the piezoelectric film, said face plate extending substantially over the entire forward surface of the head forward wall, said face plate being constructed of a metal alloy having a density substantially less than the head and a thickness less than about 0.100 inches whereby the face plate strengthens and supports the head forward wall while offsetting the additional weight of other elements.

13. A golf club assembly with a self-contained ball distance computing and indicating device, comprising: a head having a forward wall generally perpendicular to an estimated line of ball flight after impact by the club head, a shaft connected to the head, a molecularly polarized flexible plastic piezoelectric film connected to the forward wall that is compressed upon impact of the ball with the head and provides a signal proportional to the force of impact F between the forward wall and the ball, said film being mounted to receive only Z direction forces when compressed at ball impact, circuit means for receiving the signal F on a time base and integrating the signal F to provide a signal proportional to the integral $\int Fdt$, said signal $\int Fdt$ being proportioned to the exit velocity of a ball leaving the club, and circuit means for computing ball distance responsive to and $\int Fdt$ signal.

* * * * *